United States Patent [19]

Bettcher

[11] Patent Number: 4,470,251

[45] Date of Patent: Sep. 11, 1984

[54] KNITTABLE YARN AND SAFETY APPAREL MADE THEREWITH

[75] Inventor: William H. Bettcher, Amherst, Ohio

[73] Assignee: Bettcher Industries, Inc., Birmingham, Ohio

[21] Appl. No.: 891,611

[22] Filed: Mar. 30, 1978

[51] Int. Cl.[3] ..... D02G 3/12; A41D 19/00; D02G 3/36; D02G 3/38

[52] U.S. Cl. ..... 57/230; 2/161 R; 2/167; 57/210; 57/902

[58] Field of Search ..... 2/161 R, 164, 167; 139/425 R; 57/210, 229, 230, 231, 235, 232, 902, 901

[56] References Cited

U.S. PATENT DOCUMENTS

| | | | |
|---|---|---|---|
| 831,108 | 9/1906 | Ryder | 57/210 |
| 2,165,296 | 7/1939 | Oass | 57/235 X |
| 3,277,564 | 10/1966 | Webber et al. | 57/901 X |
| 3,288,175 | 11/1966 | Valko | 57/901 X |
| 3,490,224 | 1/1970 | Bourgeas | 57/210 |
| 3,572,397 | 3/1971 | Austin | 57/229 X |
| 3,699,590 | 10/1972 | Webber et al. | 57/901 X |
| 4,004,295 | 1/1977 | Byrnes, Sr. | 2/161 R |
| 4,384,449 | 5/1983 | Byrnes, Sr. et al. | 57/210 |

FOREIGN PATENT DOCUMENTS

| | | | |
|---|---|---|---|
| 1610495 | 1/1971 | Fed. Rep. of Germany . | |
| 187327 | 10/1922 | United Kingdom | 139/425 R |

OTHER PUBLICATIONS

Webber; "Metal Fibers", Modern Textiles Magazine, May, 1966, pp. 72–75.

Barry; "Textile Applications of Metal Fibers", Modern Textiles Magazine, pp. 53–56, Jun. 1967.

Allen; "Textile Applications for Fine Metallic Filaments", Modern Textiles, pp. 60–61, Mar. 1974.

*Primary Examiner*—John Petrakes

*Attorney, Agent, or Firm*—Watts, Hoffmann, Fisher & Heinke

[57] ABSTRACT

A knitted safety glove made of yarn having a core of two longitudinal strands of annealed stainless steel wire and one strand of high strength aramid fiber surrounded by an aramid fiber wrapped thereabout in one direction and a layer of nylon wrapped upon the first layer and in the opposite direction.

15 Claims, 3 Drawing Figures

KNITTABLE YARN AND SAFETY APPAREL MADE THEREWITH

BACKGROUND OF THE INVENTION

1. Field of the Invention

The invention relates to yarn suitable for machine knitting and to safety garments incorporating the yarn.

2. Description of the Prior Art

A number of patents have issued disclosing various safety garments but none has been entirely satisfactory and few have attained extensive commercial success. Knit safety gloves having been manufactured of yarn having a single stainless steel core wire wrapped only with Kevlar. Cut resistance is provided by the Kevlar wrapping and by the stainless steel wire strand in the core of the yarn. Kevlar is rough or abrasive and harsh to the feel and gloves and other garments made from such yarn are somewhat uncomfortable to the wearer, are of an unattractive color and are difficult to clean. Light and many cleaning fluids have degradative effects upon Kevlar which decreases the life of gloves and other garments made therefrom.

Applicant has found that the volume of stainless steel per unit length of yarn can be increased and thus the cut resistance of the yarn and garments made therefrom increased without lessening the knittability of the yarn by incorporating in the core two or three strands of stainless steel wire of lesser diameter than the diameter of the single strand heretofore employed and that the appearance, comfort, cleanability and life of a glove or other garment made of the yarn can be enhanced very materially by substituting nylon for the Kelvar or preferably by wrapping the Kevlar wrapped core with an outer wrapping of nylon.

SUMMARY OF THE INVENTION

The present invention provides a high strength, cut resistant, knittable yarn which is superior to prior yarns of the character to which the invention relates. The yarn is highly flexible, non-abrasive and is not deleteriously effected by ultraviolet light, and when used in fabric either woven or knitted, produces an article which can be easily cleaned or has excellent wearing and comfort qualities.

The invention further provides a knittable, multifilament yarn comprising a core part having at least one strand of small diameter flexible wire, such as, stainless steel wire, preferably annealed, of a diameter in the range of from about two thousandths of an inch (0.002") to about six thousandths of an inch (0.006"), depending upon the number of strands, and advantageously a parallel relatively non-stretchable and non-absorbant, high strength multi-filament synthetic fiber, preferably of a denier from about eight hundred (800) to about eleven hundred (1100), such as, a high strength aromatic polyamide fiber, for example, Kevlar 29 aramid, marketed by DuPont de Nemours, E. I. & Co. of Wilmington, Del. U.S.A., and at least one wrapping about the core, preferably an even number, such as, two or four wrappings of synthetic fiber wound about the core in opposite directions, the outer wrapping being advantageously a smooth non-abrasive polyamide fiber, for example, nylon. If two or more wrappings are employed the first or inner wrapping is preferably a high strength multi-filament aramid fiber, for example, Kevlar 29 aramid, (500) and the outer wrapping should be one having low friction, be non-abrasive, have a silk like hand, be fast drying, light weight, resistant to light and low in cost, preferably a polyamide, for example nylon. The invention further provides a safety garment, and more particularly, a safety glove, incorporating the yarn.

The invention further provides an article of apparel having high resistance to cutting, which has good wear qualities, is not readily work hardened, will not take a set during use, and where the outer wrapping is of nylon or like synthetic fiber the apparel has a good appearance, is light in weight, is devoid of any harsh abrasive feeling and is comfortable to wear.

Further features and advantages of the invention will be hereinafter referred to and will be apparent to those skilled in the art to which the invention belongs from the following description of the preferred embodiment of the invention and references to alternative constructions.

DESCRIPTION OF THE PREFERRED EMBODIMENT

Figure 1:
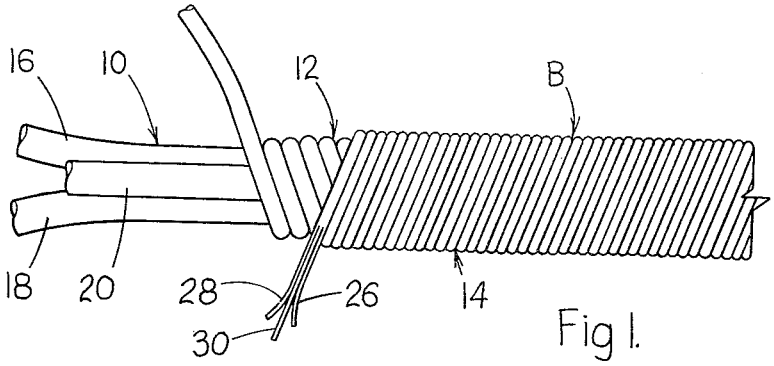
FIG. 1 is a fragmentary, diagrammatic view of yarn embodying the present invention.

The depicted glove A is exemplary of a safety article of apparel embodying the present invention and is a safety or protective glove suitable to be worn by operatives in the food processing and like industries where sharp instruments or articles, such as, knives or material having sharp edges, for example, sheet metal, glass and the like are handled and is made of multi-filament or multistrand yarn B constructed in accordance with the present invention. The glove A has the usual finger and thumb stalls respectively, and a wrist part incorporating an elastic thread or yarn C. The glove is made using conventional methods and glove knitting machinery.

The yarn B employed in the glove A comprises a core part 10 having two windings 12, 14 of synthetic fiber wound thereon in opposite directions. The fact that the wrappings 12, 14 are in different directions balances the forces incident to the wrappings and assists in holding the wrappings in place on the core 10. The windings are about fourteen (14to sixteen (16) turns per inch. The core part 10 of the yarn B comprises two strands of annealed stainless steel wire 16, 18, and one strand 20 of high strength aramid (aromatic polyamide) fiber, preferably Kevlar, such as, Kevlar 29 aramid marketed by DuPont de Nemours, E. I. & Co. of Wilmington, Del., U.S.A. The core structure is designed to provide cut resistance, knittability, flexibility and add life to the yarn; and the windings retain the core and create body. The Kevlar wrapping increases the cut resistance, and the outer wrapping of nylon which gives the yarn an oily feel enhances the knittability of the yarn and overcomes the abrasive effect of the Kevlar wrapping.

Each of the stainless steel wires 16, 18 of the core part of the yarn B has a diameter of about three thousandths of an inch (0.003"). Stainless steel wires of the size mentioned, of 304 stainless steel, fully annealed, which have a tensile strength of about one hundred and twenty five thousand pounds per square inch (125,000 lb./sq. in.) are believed to have optimum flexibility and life.

The strand of synthetic fiber 20 in the core 10 of the yarn B is a high strength relatively nonstretchable synthetic fiber, preferably having a tensile strength of about four hundred thousand pounds per square inch (400,000 lbs./sq. in.) and higher and an elongation to break of not more than about 4%, such as, multifilament aramid fiber, preferably high strength multifilament Kevlar. The size of the strand 20 is from about five hundred denier (500 D) to about eleven hundred denier (1100 D), preferably, about one thousand denier (1000 D).

The first or inner wrapping 12 on the core 10 of the yarn B is a high strength synthetic fiber, preferably a multifilament aramid fiber, such as, Kevlar 29 aramid, preferably four hundred denier (400 D). Alternatively, the wrapping 12 may be of a spun fiber. If spun fiber such as spun Kevlar is employed it should have a cotton count from 1 to 60 preferably, about 15 to 35. Filament type fibers are preferred over spun fibers because they are stronger, less abrasive and more resistant to cutting because they flex more readily than spun fibers when impacted by a sharp edge article. The outer nylon wrapping 14 of the yarn B preferably comprises three strands 26, 28, 30 of nylon. The strands 26, 28, 30 are such of about two hundred denier (200 D). The strands 26, 28, 30 may be either spun or multifilament nylon but are preferably of the multifilament type which is less absorbent, more flexible, covers better and provides a smoother surface than spun fibers. The three strands 26, 28, 30 are preferably wrapped parallel to one another and have a total size of about six hundred denier (600 D). Outer wrapping 14 of 200 to 630 denier can be used with satisfactory results.

Figure 2:
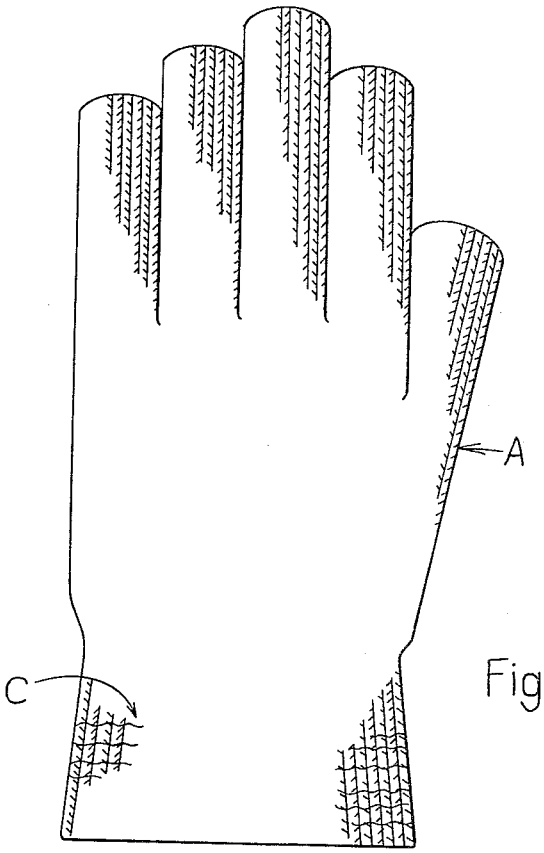
FIG. 2 is a perspective view of an article of apparel, i.e., a knitted glove, made of yarn, such as, the yarn shown in FIG. 1.
Figure 3:
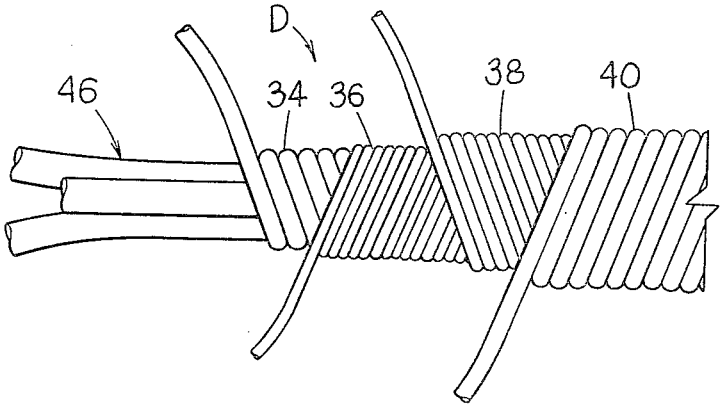
FIG. 3 is a view similar to FIG. 1 but showing a yarn of modified construction.

The yarn D shown in FIG. 3 is similar to the yarn shown in FIG. 1 except that it comprises four wrappings 34, 36, 38, 40 on the core 46 which is like the core 10 of the embodiment shown in FIGS. 1 and 2. Each wrapping 34, 36 is like the wrapping 12 previously described and are wound in opposite directions. Each wrapping 38, 40 is like the wrapping 14 of the preferred embodiment and are wound in opposite directions. The wrapping 38 is wound on the wrapping 36 in the directions opposite to the wrapping 36. Any number of wrappings may be employed on the core parts of the yarn, but an even number as previously mentioned is advantageous to balance the forces inherent when yarn of the character here involved is wrapped.

The invention is not limited to materials and sizes, etc. of the strands employed in the preferred embodiments of the invention herein described in considerable detail. The preferred embodiment of the yarn of the present invention, however, is believed to produce the optimum balance between strength, resistance to cutting, light protection, appearance, comfort, knittability, wearability, cleanability, and cost, etc. Cut resistance is to a large part a function of the quantity of metal wire in the yarn. Stainless steel core strands in excess of four thousandths of an inch (0.004") in diameter reduce the flexibility and knittability of the yarn and the wearing qualities of garments made of such yarn. Nevertheless, a single stainless steel core strand or, especially with a reduction in the outer wrapping, two stainless steel core strands of about six thousandths of an inch (0.006") in diameter can be employed in certain applications. Stainless steel strands of less than about two thousandths of an inch (0.002") in diameter have a shorter life, are relatively expensive and have not been found to be otherwise sufficiently advantageous to warrant the increased cost. Stainless steel strands having diameters between about two thousandths inches (0.002") and about four thousandths inches (0.004") have been found to be most satisfactory. Where plural strands are used to provide desirable flexibility along with a substantial quantity of metal, two strands about two thousandths of an inch (0.002) to about four thousandths of an inch (0.004") in diameter, preferably less than four thousandths of an inch (0.004"), i.e., three thousandths of an inch (0.003)to thirty five ten thousandths of an inch (0.0035"), or three strands about two thousandths of an inch (0.002) to about three thousandths of an inch (0.003") in diameter are most suitable, with two strands being preferred from a cost standpoint. While stainless steel wire strands are employed in the preferred embodiment of the invention, other kinds of metal wire strands, if desired, may be used, such as, aluminum, copper, bronze, steel, etc.

The use of a high strength fiber strand, preferably one having a tensile strength of not less than four hundred thousand pounds per square inch, such as, high strength Kevlar, for example, Kevlar 29 aramid, preferably of the multifilament type in the core is very advantageous. Multifilament is more linear than spun and slides and/or flows better with the other parts of the core during fabrication and subsequent use of an article of apparel produced therewith. The high strength multifilament core strand which relatively unstretchable takes a great deal if not the major part of the tensile load to which the yarn is subjected during knitting. It also appears to increase the flexibility of the core part of the yarn over an all metal core and in turn makes the yarn more easily knit, i.e., imparts to the yarn greater knittability. The high strength synthetic wrapping 12 increases the cut resistance, etc. of the yarn but produces a hard rough, somewhat abrasive surface formed of hills and valleys lengthwise of the yarn. It does, however provide a desirable rigid backup surface for the outer winding 14. The top or outer wrapping which is preferably a white Nylon, a stretchable synthetic fiber, tends to fill out the valleys of the wrapping immediately therebeneath and produce a yarn having a good appearance and a relatively smoother non-abrasive surface. Apparel produced with yarn of the present invention has a relatively soft non-abrasive outer surface and maximum comfort.

The depicted glove is a safety glove designed for use in the food processing industries and is highly cut resistant, readily cleanable, comfortable to wear, nice appearing, flexible and relatively non-absorbent. The last characteristic of the glove is very important in the food processing industries. The glove is also excellent chemical, abrasive and fatigue resistant, is also resistant to the transfer or heat or cold, is conformable, does not acquire a set during use, non-shrinkable, is light in weight, comfortable to wear and provides a secure grip. As previously mentioned the yarn of the invention is not limited to the specific sizes, materials, etc. mentioned, for example, one or more of the coverings on the core part of the yarn could be of a braided material and/or made of or include other synthetic fiber, such as, a polyester (e.g., Dacron) or material other than synthetic fiber. The outer core covering may be one extruded on the yarn or the outer covering could be of synthetic strand material melted subsequent to application to produce a smooth finish.

While the invention have been described as embodied in a knit safety glove, it is to be understood that the yarn of the present invention can be used to make other fabrics and articles of apparel, safety or otherwise, such as, safety aprons, etc. for use in the meat processing and other industries.

From the foregoing description of the preferred embodiment of the invention it will be apparent that the advantages of the invention heretofore enumerated and others have been accomplished and that there has been provided an improved knittable yarn and safety articles of apparel made therewith having superior qualities.

While two preferred embodiments of the invention have been described in considerable detail, the invention is not limited to the specific constructions and article of apparel shown and described, it is the intention to hereby cover all variations and alternative constructions thereof which come within the practice of those skilled in the art to which the invention relates.

What is claimed is:

1. A knittable yarn comprising: a core having two or three strands of stainless steel wire the diameter of each of which is from about two thousandths of an inch (0.002") to about four thousandths of an inch (0.004") and at least one strand of a non-stretchable high strength synthetic fiber uneffected by moisture and having a denier of about 1000, such as, a high strength aramid fiber; and at least two strands of a synthetic fiber wrapped about said core in opposite directions with one wrapping being on top of the other, at least one inner wrapping of which is a non-stretchable, high strength, synthetic fiber uneffected by moisture and having a denier of about 400, such as, a high strength aramid fiber, and the outer wrapping of which is nylon having a denier of about 600 to 630.

2. A knittable yarn comprising: a core having two or three strands of stainless steel wire the diameter of each of which is from about two thousandths of an inch (0.002") to about four thousandths of an inch (0.004") and at least one strand of a non-stretchable high strength synthetic fiber uneffected by moisture and having a denier of about 1000, such as, a high strength aramid fiber; and at least two strands of a synthetic fiber wrapped about said core in opposite directions with one wrapping being on top of the other, at least one inner wrapping of which is a non-stretchable, high strength, synthetic fiber uneffected by moisture and having a denier of about 400, such as, a high strength aramid fiber, and the outer wrapping of which is composed of three strands of nylon having a combined denier of about 600 to about 630.

3. A safety glove knit at least in part of yarn comprising: a core having two or three strands of flexible wire the diameter of each of which is from about two thousandths of an inch (0.002") to about four thousandths of an inch (0.004") and at least one strand of moisture resistant, non-stretchable high strength synthetic fiber, such as, a high strength aramid fiber; and at least two strands of a synthetic fiber wrapped about said core in opposite directions with one wrapping being on top of the other, at least one inner wrapping of which is a non-stretchable, high strength, synthetic material uneffected by moisture, such as, a high strength aramid fiber, and the outer wrapping of which is nylon.

4. A safety glove knit at least in part of yarn comprising: a core having two or three strands of stainless steel wire the diameter of each of which is from about two thousandths of an inch (0.002") to about four thousandths of an inch (0.004") and at least one strand of a non-stretchable high strength synthetic fiber uneffected by moisture and having a denier of about 1000, such as, a high strength aramid fiber; and at least two strands of a synthetic fiber wrapped about said core in opposite directions with one wrapping being on top of the other, at least the inner wrapping of which is a non-stretchable high strength, synthetic fiber uneffected by moisture and having a denier of about 400, such as, a high strength aramid fiber, and the outer wrapping of which is nylon having a denier of about 630.

5. A cut resistant yarn suitable for machine knitting, comprising a core having only two or three strands of flexible fully annealed stainless steel wire each having a diameter from about 0.002 inch to about 0.004 inch and at least one strand of non-stretchable high strength aramid fiber having a tensile strength greater than that of the wire and a denier between about 500 and about 1100; and at least two wrappings of synthetic fiber wound about the core, one of said wrappings being a non-stretchable high strength aramid fiber having a tensile strength greater than that of the wire and of a denier between about 200 and about 500, and the other being an outer wrapping of polyamide or polyester fiber of a denier between about 600 and 630.

6. A cut resistant yarn suitable for machine knitting, comprising a core having at least two strands of flexible fully annealed stainless steel wire each having a diameter from about 0.002 inch to about 0.004 inch and at least one strand of non-stretchable high strength synthetic fiber having a tensile strength of at least about 400,000 pounds per square inch and of a denier between about 500 and about 1100; and at least two wrappings of synthetic fiber wound about the core, one of said wrappings being a non-stretchable high strength synthetic fiber having a tensile strength greater than that of the wire and of a denier between about 200 and 500, and the other being an outer wrapping of polyamide or polyester fiber of a denier between about 600 and 630.

7. A cut resistant yarn suitable for machine knitting, comprising a core having two or three strands of flexible fully annealed stainless steel wire each having a diameter from about 0.002 inch to about 0.004 inch and at least one strand of non-stretchable high strength synthetic fiber having a tensile strength greater than that of the wire and of a denier between about 500 and about 1100; and at least two wrappings of synthetic fiber wound about the core, one of said wrappings being a non-stretchable high strength synthetic fiber having a tensile strength greater than that of the wire and of a denier between about 200 and about 500, and the other being an outer wrapping of polyamide or polyester fiber of a denier between about 600 and 630.

8. A cut resistant yarn suitable for machine knitting, comprising a core having only two or three strands of flexible fully annealed stainless steel wire each having a diameter from about 0.002 inch to about 0.004 inch and at least one strand of non-stretchable high strength synthetic fiber, such as a high strength aramid fiber, having a tensile strength greater than that of the wire an of a denier between about 500 and about 1100; and at least two wrappings of synthetic fiber wound about the core, one of said wrappings being a non-stretchable high strength synthetic fiber, such as a high strength aramid fiber, having a tensile strength greater than that of the wire and of a denier between about 200 and about 500, and the other being an outer wrapping of polyamide of polyester fiber of a denier between about 600 and 630.

9. A cut resistant yarn suitable for machine knitting, comprising a core having only two or three strands of flexible fully annealed stainless steel wire each having a diameter from about 0.002 inch to about 0.004 inch and at least one strand of non-stretchable high strength aramid fiber having a tensile strength greater than that of the wire; and at least two wrappings of synthetic fiber wound about the core, one of said wrappings being a non-stretchable high strength aramid fiber having a tensile strength greater than that of the wire and the other being an outer wrapping of polyamide or polyester fiber.

10. A cut resistant yarn suitable for machine knitting, comprising a core having at least two strands of flexible fully annealed stainless steel wire each having a diameter from about 0.002 inch to about 0.004 inch and at least one strand of non-stretchable high strength synthetic fiber having a tensile strength of at least 400,000 pounds per square inch; and at least two wrappings of synthetic fiber wound about the core, one of said wrappings being a non-stretchable high strength synthetic fiber having a tensile strength greater than that of the wire and the other being an outer wrapping of polyamide or polyester fiber.

11. A cut resistant yarn suitable for machine knitting, comprising a core having two or three strands of flexible fully annealed stainless steel wire each having a diameter from about 0.002 inch to about 0.004 inch and at least one strand of non-stretchable high strength synthetic fiber, having a tensile strength greater than that of the wire; and at least two wrappings of synthetic fiber wound about the core, one of said wrappings being a non-stretchable high strength synthetic fiber having a tensile strength greater than that of the wire and the other being an outer wrapping of polyamide or polyester fiber.

12. A cut resistant yarn suitable for machine knitting, comprising a core having only two or three strands of flexible fully annealed stainless steel wire each having a diameter from about 0.002 inch to about 0.004 inch and at least one strand of non-stretchable high strength synthetic fiber, such as a high strength aramid fiber, having a tensile strength greater than that of the wire; and at least two wrappings of synthetic fiber wound about the core, one of said wrappings being a non-stretchable high strength synthetic fiber, such as high strength aramid fiber, having a tensile strength greater than that of the wire and the other being an outer wrapping of polyamide or polyester fiber.

13. A cut resistant machine-knitted article of apparel at least in part made of yarn comprising a core having at least two strands of flexible fully annealed stainless steel wire each having a diameter from about 0.002 inch to about 0.004 inch and at least one strand of non-stretchable high strength synthetic fiber having a tensile strength greater than that of the wire and of a denier between about 500 and about 1100; and at least two wrappings of synthetic fiber wound about the core, one of said wrappings being a non-stretchable high strength synthetic fiber having a tensile strength greater than that of the wire and a denier of between about 200 and about 500, and the other being an outer wrapping of polyamide or polyester fiber of a denier between about 600 and 630.

14. A cut resistant machine-knitted glove made of yarn comprising a core having two or three strands of flexible fully annealed stainless steel wire each having a diameter from about 0.002 inch to about 0.004 inch and one strand of non-stretchable high strength synthetic fiber, such as a high strength aramid fiber, having a tensile strength greater than that of the wire and of a denier between about 500 and about 1100; and two wrappings of synthetic fiber wound about the core, one of said wrappings being a non-stretchable high strength synthetic fiber, such as high strength aramid fiber, having a tensile strength greater than that of the wire and a denier of between about 200 and about 500, and the other being an outer wrapping of polyamide or polyester fiber of a denier between about 600 and 630.

15. A cut resistant machine-knitted glove made of yarn comprising a core having only two or three strands of flexible fully annealed stainless steel wire each having a diameter from about 0.002 inch to about 0.004 inch and at least one strand of non-stretchable high strength aramid fiber, having a tensile strength greater than that of the wire and of a denier between about 500 and about 1100; and at least two wrappings of synthetic fiber wound about the core, one of said wrappings being a non-stretchable high strength aramid fiber, having a tensile strength greater than that of the wire and a denier of between about 200 and about 500, and the other being an outer wrapping of polyamide or polyester fiber of a denier between about 600 and 630.

* * * * *